United States Patent [19]

Mewes

[11] 4,446,675

[45] May 8, 1984

[54] ARTICLE-INSERTING STATION FOR PACKING MACHINE

[75] Inventor: Claus J. Mewes, Adlikon b.Regensdorf, Switzerland

[73] Assignee: Prometag AG, Regensdorf, Switzerland

[21] Appl. No.: 273,443

[22] Filed: Jun. 15, 1981

[30] Foreign Application Priority Data

Jun. 19, 1980 [CH] Switzerland ..... 4716/80

[51] Int. Cl.[3] ..... B65B 35/44; B65B 35/50

[52] U.S. Cl. ..... 53/535; 53/537; 198/422; 414/92

[58] Field of Search ..... 53/447, 499, 537, 535, 53/538, 531, 501, 541, 540, 202, 247, 251; 414/92, 95, 29; 198/422, 423

[56] References Cited

U.S. PATENT DOCUMENTS

| | | | |
|---|---|---|---|
| 2,544,125 | 3/1951 | Bain et al. | 53/537 X |
| 2,831,586 | 4/1958 | Patrick | 53/540 X |
| 3,509,688 | 5/1970 | Hartbauer et al. | 53/537 X |
| 3,743,118 | 7/1973 | Fluck | 53/541 X |
| 3,902,587 | 9/1975 | Checcucci | 53/537 X |
| 4,181,213 | 1/1980 | Deutschlander et al. | 198/422 X |

FOREIGN PATENT DOCUMENTS

| | | | |
|---|---|---|---|
| 2523242 | 12/1975 | Fed. Rep. of Germany | 53/541 |

*Primary Examiner*—Horace M. Culver

*Attorney, Agent, or Firm*—Karl F. Ross; Herbert Dubno

[57] ABSTRACT

The inserting station for a packing machine for inserting articles in boxes in layers comprises a plurality of lifting elements following the articles in the conveying direction. These lifting elements at least partly pass through the article conveyor means in order to successively raise the articles. The in each case raised lifting element forms a stop member for the following article. Each lifting element is shorter in the conveying direction than the extension of the article therein, which represents a measure for the overlap of the articles in a layer. In this way it is possible to position for forming a layer and overlap articles with an all-round flat or irregular edge.

3 Claims, 3 Drawing Figures

ARTICLE-INSERTING STATION FOR PACKING MACHINE

The present invention relates to an inserting station for a packing machine for inserting articles in selling or dispatch boxes in stacked layers, with means for combining a plurality of individually supplied articles into a complete layer and an inserting head equipped with suction nozzles.

BACKGROUND OF THE INVENTION

The present Applicant manufactures packing machines of this type in which the articles are supplied by a conveyor belt or side or an air cushion from a final production stage to a collecting or inserting station. For a rational insertion of the articles into the selling or dispatch boxes the articles are often allowed to pile up a number of times and are then separated again e.g. for counting, shaping, inspection, etc. and are then inserted in complete layers into the awaiting boxes.

It is possible in this way to pack e.g. block-shaped articles of confectionery and also technical components, provided that they have a certain material hardness and a geometrical shape preventing clogging or jamming.

However, if the articles to be packed are relatively soft or have an irregular geometrical shape considerable difficulties are encountered in forming complete layers to be taken up by the insertion head in the case of jamming of the said articles. It has hitherto been impossible to suitably form layers of several articles where a space-saving overlap of said articles has been required. Such an article overlap in the individual layers is advantageous in packs of elongated chocolate bars with irregular edges or powder-containing bags, e.g. "Ovomaltine" bags with an all-round flat edge. It is also necessary for bringing about a significant reduction in the volume of the box.

Thus, it is the problem of the present invention to so further develop an inserting station of the aforementioned type that it is possible to form layers with or without an overlap of articles having a limited or no resistance to clogging or jamming.

According to the invention this is achieved by a plurality of lifting elements following the conveying direction of the articles and passing through the preferably continuously moved belt-like conveying means which, after depositing an article, can individually and successively be moved into an upper end position by lifting means, the in each case raised lifting element forming a stop member for the following article deposited on the next lifting element.

Such an inserting station is preferably constructed in such a way that a fixed stop member cooperates with the furthest forward lifting element. It is advantageous if each of the lifting elements has a length in the conveying direction which is shorter than the extension of the articles in said direction.

According to an advantageous further development the lifting means for the lifting elements are of an electromagnetic and/or hydraulic and/or pneumatic nature and that further each lifting element for determining the depositing of an article is equipped with glass fiber optics.

It is advantageous if the lifting means for the lifting elements are in operative connection by means of a control device with the glass fibre optics of each lifting element and after occupying and raising the final lifting element the control device produces a first output signal for the predetermined operation of the inserting head and a second output signal, delayed with respect to the first output signal for returning the lifting elements to their lower end position.

According to the invention the inserting station can be used on a packing machine, which is characterized in that on either side of the belt-like conveying means for the articles in the vicinity of the lifting elements there are standing surfaces for the boxes alternately loaded in layers by the inserting head with in each case one complete layer of articles removed from the lifting elements.

BRIEF DESCRIPTION OF THE DRAWING

An exemplified embodiment of the invention is described hereinafter relative to the drawing, in which.

SPECIFIC DESCRIPTION

The invention will now be described in greater detail relative to a device for packing bags with an all-round flat edge. However, the invention is not limited to this particular use and in fact permits a large number of constructional variants.

Figure 1:
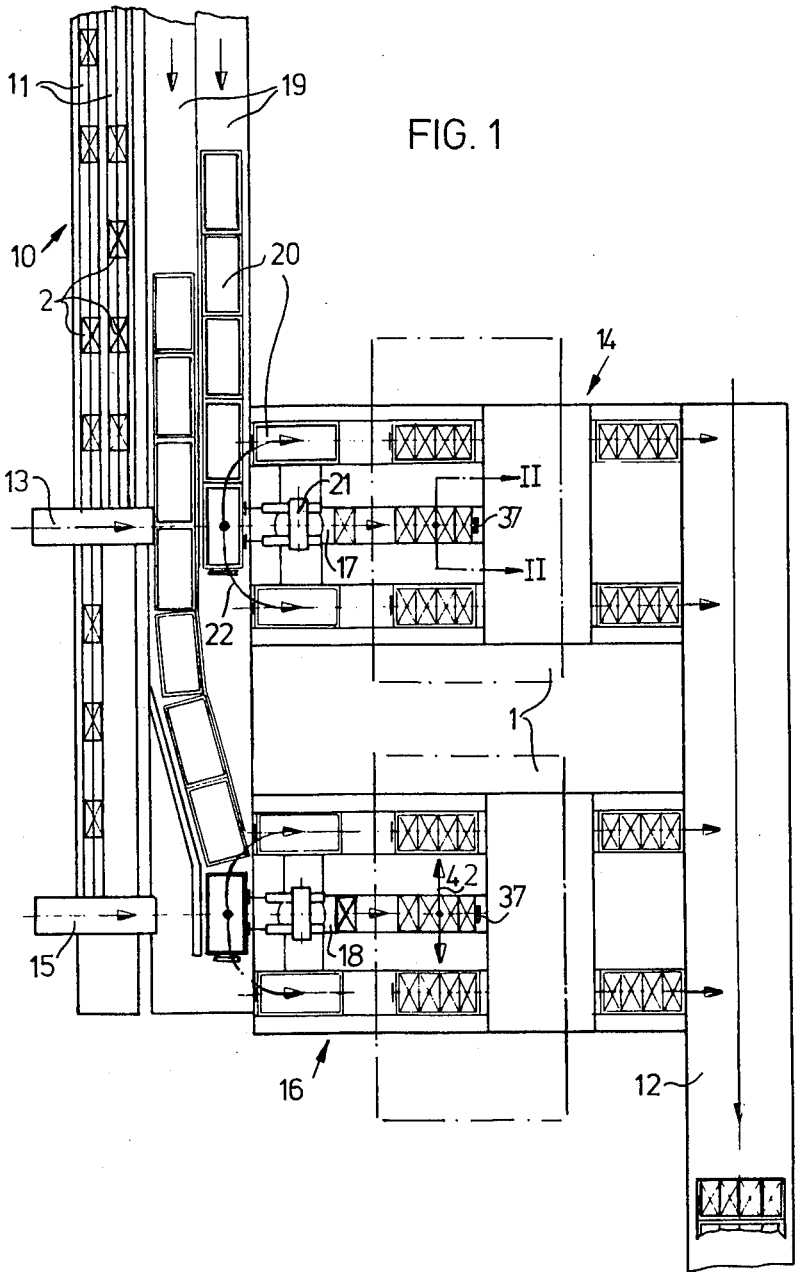
FIG. 1 is a diagrammatic plan view of a conveying installation from a final production stage for articles which are to be packed to an inserting station with a plurality of boxes and articles.

The installation shown in FIG. 1 comprises a conveyor 10 coming from a not shown final production stage, an unloading conveyor belt 12 and two intermediate, parallel packing stages 14 and 16, comprising in each case an inserting station 1 according to the invention.

By means of two parallel belts 11 conveyor 10 individually feeds in bags 2 at a predetermined cycle time of e.g. 0.5 sec and level with packing stages 14 and 16 are moved by means of the timed members 13, 15 on to the belt-like conveyor means 17, 18 of packing stages 14, 16. Conveyor 10 also comprises two parallel belts 19 by means of which boxes 20 are supplied in two rows. At each packing stage 14 or 16 these boxes 20 are removed from the particular belt 19 by a suction swivel head 21 and are alternately set down to the right and left in accordance with arrow 22 alongside the conveyor means 17, 18 of packing stages 14, 16 and moved into the particular inserting station 1. This can be brought about by intermittently driven, not shown conveyor belts or in some other conventional manner. By means of these conveyor belts the loaded boxes 20 pass on to the unloading conveyor belt 12.

Figure 2:
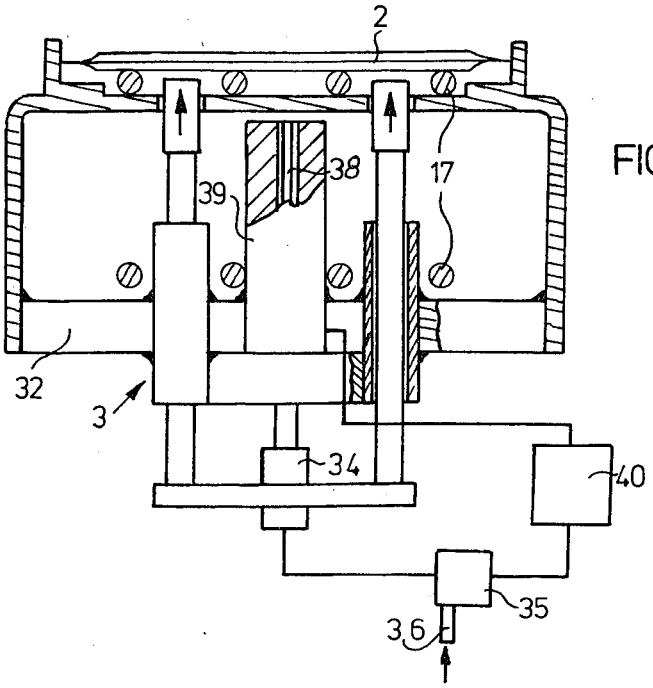
FIG. 2 is on a larger scale and in vertical section along section line II—II of FIG. 1 a specific embodiment of the inserting station.
Figure 3:
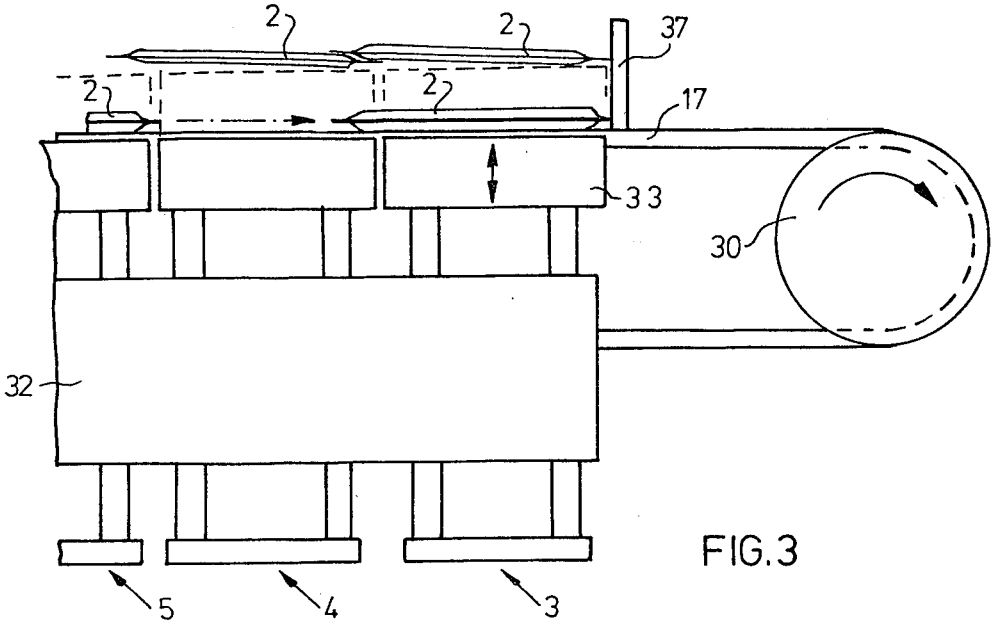
FIG. 3 is the arrangement according to FIG. 2 in a cutaway side view.

The inserting station 1 of each packing stage 14, 16 is illustrated in greater detail in FIGS. 2 and 3. In this connection it can be gathered from FIG. 1 that inserting station 1 in each case combines four bags 2 into a complete layer, said bags overlapping. By means of a not shown inserting head the bags are then introduced in layer form and in alternating manner in accordance with arrow 42 in FIG. 1 into boxes 20 on either side of conveyor means 17, 18. Such inserting heads are known per se and need not therefore be explained in greater detail. In addition, the arrangement is not limited to article layers consisting of four articles and the layers can have more or less articles.

Thus, in the present case inserting station 1 comprises four lifting elements 3, 4 following in the conveying direction of articles 2. The lifting elements at least in part pass through the article conveyor means 17, in this case formed by a plurality of rope lines continuously passing round pulleys 30. The lifting elements 3, 4 in each case comprise webs 33 guided in a frame 32 and the lifting means for the same are in this case constituted by a ram cylinder system 34.

In principle the lifting means for raising or lowering the lifting elements or their webs can be of an electromagnetic, hydraulic or pneumatic nature.

In the present case the ram cylinder system 34 is connected by means of controllable valve means 35 to an air intake line 36.

As can be gathered from FIG. 3 the first incoming bag 2 with its front edge strikes a fixed stop member 37 and thereby extends completely over the double web 33 of the first lifting element 3. As can be gathered from the drawing in the conveying direction the lifting webs are in each case shorter than the extension of the bags 2 in said direction, so that in each case an edge area projects rearwards from bag 2 for overlapping the following bag with respect to the lifting web thereof. When the first bag 2 has assumed its thus defined end position over its lifting element, said layer is transferred from a glass fibre optics 38 or the like in a column 39 of the arrangement in the form of a locating signal to a control device 40 which operates valve 35 by means of a signal, so that the ram cylinder system 34 brings the web arranement 33 of lifting element 3 into an upper end position. This takes place so rapidly that the raised web arrangement 33 acts as a stop member for the following bag 2, the layer of four bags being completed in the previously described manner.

FIG. 3 clearly shows the overlap of bags 2 in their raised position.

It is clear and requires no further explanation that after raising the final and in this case fourth bag 2 a finish signal can be produced, which starts the operation of the inserting head. When the inserting head has taken up the overlapping layer of four bags by suction, a return signal can be produced by the said head or control device 40, which returns to the lower end position all the lifting elements 3, 4 before the next bag arrives and then the next cycle can commence.

In this way it is now possible to reliably position for layer formation and overlap articles with all-round flat or irregular edges, the length difference between the lifting element and the article in the article conveying direction representing a measure for the overlap of the articles within a layer.

I claim:

1. In a packaging machine in which a layer of articles is transferred to a container, the improvement which comprises in combination:

conveyor means defining a transport path for the movement of succession of articles in a given direction along said path;

means along said path forming a stop for a first such article adapted to form a given layer;

a plurality of lifting elements spaced along said path from said stop in a direction opposite said given direction and normally disposed below said path, each of said lifting elements having a dimension in said given direction which is less than a dimension in said given direction of said articles;

respective actuators connected with said lifting elements for raising same above said path upon energization of said actuators; and control means for sequentially energizing said actuators to lift a first actuator proximal to said stop upon the engagement thereby of an article carried along said path in said given direction whereby a surface of the lifting element of said first actuator forms an abutment for a following article, energizing the actuator of the element of said following article to raise the same and form an abutment from the raised element for the next article, and repeating the energization of said actuators in succession until said layer is formed above said path at a level assumed by said elements upon the energization of the actuators of the articles forming said layer.

2. The improvement defined in claim 1 wherein said control means includes fiber optical means for each element responsive to the position of an article therein.

3. The improvement defined in claim 2 wherein said control means is constructed and arranged to produce the first signal for energizing each actuator and a second signal delayed with respect to the first signal for returning each actuator in a position in which the respective element lies below said path.

* * * * *